US007518467B2

(12) United States Patent
McKinley et al.

(10) Patent No.: US 7,518,467 B2
(45) Date of Patent: Apr. 14, 2009

(54) DYNAMIC, NON FREQUENCY DISPERSIVE, RF POWER DIVISION BY MEANS OF VARIABLE DIELECTRIC MATERIAL PROPERTIES

(75) Inventors: William S. McKinley, Clermont, FL (US); Jeffery A. Dean, Clermont, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 237 days.

(21) Appl. No.: 11/455,731

(22) Filed: Jun. 20, 2006

(65) Prior Publication Data

US 2007/0216494 A1 Sep. 20, 2007

Related U.S. Application Data

(60) Provisional application No. 60/782,363, filed on Mar. 14, 2006.

(51) Int. Cl.
*H01P 5/12* (2006.01)

(52) U.S. Cl. ..... 333/117; 333/109; 333/116; 333/125

(58) Field of Classification Search ..... 333/109, 333/115, 116, 117, 125, 127, 128
See application file for complete search history.

(56) References Cited

U.S. PATENT DOCUMENTS

| | | | | |
|---|---|---|---|---|
| 6,335,662 | B1 * | 1/2002 | Del Rosario et al. | 333/111 |
| 6,788,165 | B2 | 9/2004 | Runyon | |
| 6,864,837 | B2 | 3/2005 | Runyon et al. | |
| 6,875,369 | B1 | 4/2005 | Tidrow et al. | |
| 2004/0178862 | A1 * | 9/2004 | Kaplan et al. | 333/117 |

* cited by examiner

*Primary Examiner*—Benny Lee
*Assistant Examiner*—Kimberly E Glenn
(74) *Attorney, Agent, or Firm*—Birch, Stewart, Kolasch & Birch, LLP

(57) ABSTRACT

A monolithic thin film variable power divider is disclosed for variable power level distribution. The thin film power divider includes a substrate having a main surface, a first stage and a second stage, each formed as thin film networks on the main surface of the substrate. The first stage includes a plurality of transmission lines, at least one of the transmission lines having a variable dielectric deposition layer providing variable power level distribution. The variable dielectric deposition is a paraelectric, such as Barium-Strontium-Titanate. The second stage includes a hybrid combiner. The thin film power divider is capable of operating at frequencies extending into the millimeter wave spectrum. The thin film power divider provides a cost effective device that varies the balance of power through a multiport RF distribution network while simultaneously maintaining little, or low, frequency dispersion during the dynamic dissemination process.

8 Claims, 3 Drawing Sheets

DYNAMIC, NON FREQUENCY DISPERSIVE, RF POWER DIVISION BY MEANS OF VARIABLE DIELECTRIC MATERIAL PROPERTIES

CROSS-REFERENCE TO RELATED APPLICATIONS

A related application entitled "Universal Antenna Polarization Selectivity via Variable Dielectric Control" is being filed concurrently herewith, to Jeffery A. Dean and William S. McKinley, Ser. No. 11/472,151, and the specification and claims thereof are incorporated herein by reference.

This application claims priority to and the benefit of the filing of U.S. Provisional Patent Application Ser. No. 60/782,363, entitled "Single Input Circuit and Slant Polarization Selectivity by Means of Dielectric Control", filed on Mar. 14, 2006, and the specification and claims thereof are incorporated herein by reference.

BACKGROUND OF THE INVENTION

1. Field of the Invention

The present invention relates to methods and apparatuses to obtain variable power level distribution through a corporate power divider network. The present invention relates to monolithic thin film power dividers. The present invention relates to an actively balanced power division technique suitable for RF signals in the millimeter wave spectrum.

2. Description of Related Art

Multiple polarization antennas are typically implemented through a conjunction of either electrical or mechanical switching, electrical or mechanical attenuation, electrical or mechanical phase shifting, and dedicated transmission line routing definitions. Attenuators reduce the RF efficiency by "throwing away" RF power to achieve the desired power balance between the orthogonal ports.

In the field of wireless base station antenna systems, U.S. Pat. No. 6,864,837 discloses an antenna having a beam steering circuit including variable power divider and a multi-beam beam forming network. FIG. 3 illustrates a conceptual view of the prior art variable power divider. The variable power divider preferably uses a single adjustable control element 34, typically a microstrip wiper arm, to divide the input voltage signal into the voltage drive signals $V_1$ and $V_2$, which have complementary amplitude over the range of voltage amplitude division. In FIG. 3, "A" represents the 50% division point. The power division varies smoothly between position "C", in which 100% power goes to $V_1$, to "B", in which zero power goes to $V_1$.

The adjustable control element 34 operates by swinging along the transmission line arc in order to alter the relative lengths of transmission lines between the single input port and the two input ports to the hybrid combiner stage. The voltage drive signals $V_1$ and $V_2$ provide input signals to the multi-beam forming network, which is typically configured as an orthogonal two-by-four beam forming network or a four-by-four Butler matrix. The beam forming network outputs beam driving signals that each include a component from each of the voltage drive signals $V_1$ and $V_2$. As the induced relative phase differences combine within the multi-beam beam forming network, a desired power distribution balance is achieved. However, because of the mechanical operation of the adjustable control element, the beam steering circuit is limited to low frequency applications.

Piezoelectric materials include a subgroup consisting of pyroelectric materials, which in turn include ferroelectric materials. A ferroelectric crystal is a crystal which belongs to the pyroelectric family (i.e., shows a spontaneous electric polarization), and whose direction of spontaneous polarization can be reversed by applying an electric field. When the electric field is removed, the polarization still remains. To eliminate the polarization, an external opposite electric field is required.

An antiferroelectric crystal is a crystal whose structure can be considered as being composed of two sublattices polarizing spontaneously in antiparallel directions at least in one projection, and whose ferroelectric phase can be induced by applying an electric field. Subsequently, in antiferroelectrics, the induced phase transition is observed as a double hysteresis loop. Also, above a certain temperature, ferroelectricity in most ferroelectric materials will disappear and transition to paraelectric.

Furthermore, the spontaneous polarization in ferroelectrics or the sublattice polarization in antiferroelectrics can be regarded as a structural perturbation on a nonpolarized crystal. The non-perturbed crystal structure can be considered as a paraelectric structure. The paraelectric structure can be realized by making the ferroelectric polarization or the sublattice polarization equal to zero. The phase having a paraelectric structure is called a paraelectric phase.

Ferroelectricity and antiferroelectricity are also based on the dielectric behavior of the crystal. A change in the dielectric constant induced by applying an electric field causes a change in the effective electrical length of the device.

U.S. Pat. No. 6,875,369 to Tidrow et al., dated Apr. 5, 2005, discloses examples of ferroelectric/paraelectric materials. In particular, Tidrow discloses materials derived from Barium-Strontium-Titanate ($Ba_{1-x}Sr_xTiO_3$ "BST").

BRIEF SUMMARY OF THE INVENTION

Disclosed embodiments of the power divider are capable of power division at higher frequencies than conventional power dividers. An aspect of the present invention is a variable power divider capable of operating at frequencies extending into the millimeter wave spectrum, in a cost effective device. A further aspect of the present invention is the capability of varying the balance of power through a multiport RF distribution network while simultaneously maintaining little, or low, frequency dispersion during the dynamic dissemination process.

To achieve these and other advantages and in accordance with the purpose of the present invention, as described herein, there is provided a monolithic thin film variable power divider for variable power level distribution, including a substrate having a main surface, a first stage and a second stage, each formed as thin film networks on the main surface of the substrate. The first stage includes a plurality of transmission lines, at least one of the transmission lines having a variable dielectric deposition layer providing variable power level distribution. The second stage includes a hybrid combiner.

To achieve these and other advantages and in accordance with the purpose of the present invention, as described herein, there is provided a monolithic thin film power divider wherein a variable dielectric deposition layer is made of a variable crystalline dielectric material that is capable of electric polarization by application of voltage.

To achieve these and other advantages and in accordance with the purpose of the present invention, as described herein, there is provided a monolithic thin film power divider wherein the variable dielectric material is a compound of Barium-Strontium-Titanate.

To achieve these and other advantages and in accordance with the purpose of the present invention, as described herein, there is provided a monolithic thin film power divider wherein each of the plurality of transmission lines includes a semiconductor cap connected to each end of the variable dielectric deposition layer, and a metal strip line formed over the variable dielectric deposition layer and each semiconductor cap, which provides a capacitor at each end of the respective transmission line.

To achieve these and other advantages and in accordance with the purpose of the present invention, as described herein, there is provided a variable power divider, including a substrate, a single input port receiving an RF signal, a variable power splitter having a plurality of transmission lines, wherein at least one of the transmission lines is composed of a variable dielectric material. At least one control line associated with the respective transmission line composed of variable dielectric material is for supplying a respective input control voltage. A hybrid power combiner having a plurality of input ports and a plurality of output ports is provided wherein the input ports are connected to respective transmission lines. A complex power vector of the at least one transmission line is adjusted by changing an applied voltage to the variable dielectric material of the respective transmission line. The variable power splitter and hybrid power combiner are formed on the substrate. The hybrid power combiner adds or subtracts complex power vectors of respective transmission lines in order to provide power to an output port or the plurality of output ports.

To achieve these and other advantages and in accordance with the purpose of the present invention, as described herein, there is provided a variable power divider, including a quartz substrate having a metal backing layer, a first layer formed on the surface of the quartz substrate. The first layer includes a first metal strip formed as a y-connection providing an input port for the variable power divider. Each y-connection feeds a first semiconductor cap, a variable dielectric deposition strip made of a paraelectric material, and a second semiconductor cap. A second metal strip pattern is formed as a power combiner network. The second semiconductor caps are connected to input ports of the power combiner network. A second layer is formed on the first layer such that a metal strip is formed on the first cap, the second cap, and the dielectric deposition strip. The metal strip includes a plurality of input lines, one for each branch of the first metal strip. When a voltage control signal is supplied at a respective input line, a complex power vector for each respective dielectric deposition strip is adjusted and a RF signal provided at the input to the power divider is divided by vector arithmetic.

To achieve these and other advantages and in accordance with the purpose of the present invention, as described herein, there is provided a method of varying and dividing RF power in an RF power divider having a single input port and multiple output ports, which are served by respective transmission lines, each transmission line including a variable dielectric deposition layer. The method includes receiving an RF signal, receiving a control voltage at a control port for each respective transmission line, aligning crystalline structure of each variable dielectric layer based on the respective applied control voltage, dividing power of the RF signal equally, distributing the divided power to the transmission lines. Each aligned crystalline structure provides a respective complex power vector. The power is recombined by vector arithmetic over the complex power vectors, thereby producing power level distributed substantially without frequency dispersion.

To achieve these and other advantages and in accordance with the purpose of the present invention, as described herein, there is provided a method of varying and dividing RF power including steps of adjusting the divided power over a range from zero degrees to ninety degrees based on varying control voltage, and controlling respective phase over the range of divided power.

To achieve these and other advantages and in accordance with the purpose of the present invention, as described herein, there is provided a method of varying and dividing RF power, wherein the frequency of the RF signal is within the millimeter band spectrum.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE INVENTION

For applications such as RADAR and passive imaging, it is desirable to realize a single input device that is capable of generating multiple polarizations without loss of overall RF power efficiency. A typical single-input antenna will have only a single polarization (such as linear or circular) associated with it. In order to achieve additional polarizations, two RF antenna inputs are required. Some additional polarization states can be produced by controlling the relative phasing between antenna ports. In order to generate arbitrary linear, elliptical, or circular polarization, both phase and amplitude need to be controlled.

A power divider of the present invention constitutes a component of an apparatus to control antenna polarization. A power divider of the present invention achieves power division by an approach based on vector arithmetic instead of based on transmission line impedance tapering. A power divider includes a variable dielectric power splitter feeding a hybrid "branch line" combiner network. Altering power vectors in the power splitter and adding or subtracting the complex power vectors with the hybrid combiner network achieves power vector cancellation.

Figure 1:
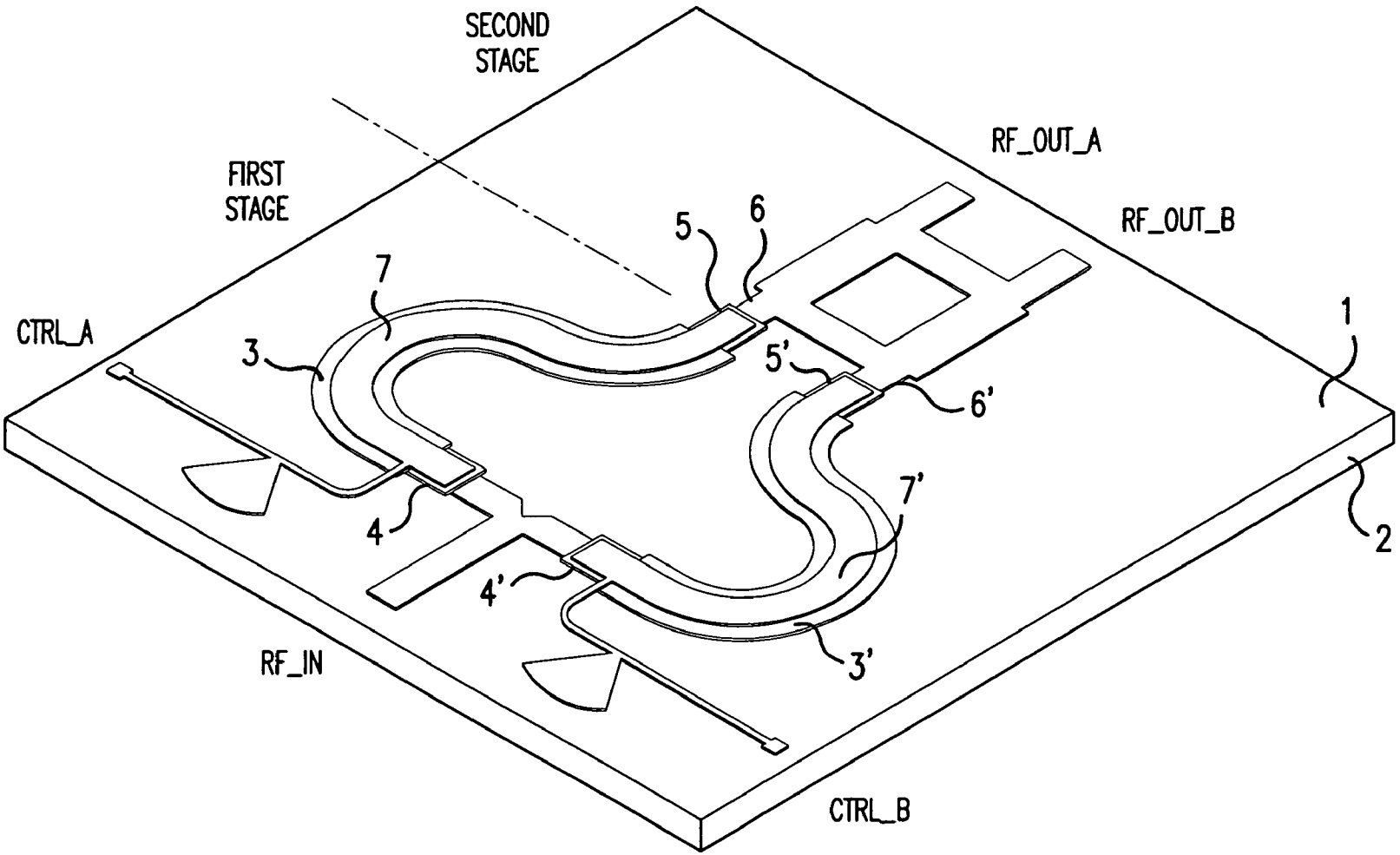
FIG. 1 is a perspective view of a monolithic thin film power divider in a preferred embodiment.

FIG. 1 shows a preferred embodiment of the power divider. The power divider has a first stage and a second stage. The first stage, preferably a center-fed RF power splitter, feeds the second stage, preferably having a hybrid combiner network. The first stage includes two independent transmission lines and receives input from a single RF input, RF_IN. The two independent transmission lines are formed over variable dielectric material. The variable dielectric material is preferably a paraelectric, such as BST.

The power divider is preferably formed on a quartz substrate 1 having a gold backing layer 2. At a first layer formed on the surface of the quartz substrate, the variable dielectric layer is preferably provided as a curved strip, formed using BST deposition, 3, 3' terminated at each end by a short silicon nitride deposition 4, 4', 5, 5'. A final deposition of gold 7,7' is placed atop the BST and silicon nitride material depositions. The small overlap between bottom and top gold, separated by the thin silicon nitride deposition, forms a coupling capacitor capable of passing RF energy in the frequency band of interest. The top deposition of gold residing chiefly upon BST material forms a variable length transmission line. The silicon nitride deposition 4, 4' connects a gold strip serving as the RF_IN line and the variable length transmission line. The silicon nitride deposition 5, 5' at the other end of the variable length transmission line provides connectivity to the respective input port 6, 6' of the hybrid combiner network. Respective silicon nitride caps and variable dielectric strip, topped with gold deposition, form transmission lines of the power splitter. Each upper gold strip layer 7, 7' is associated with a control input port, CTRL_A and CTRL_B, for providing voltage to the associated upper gold strip 7, 7'. These DC control inputs are located on the quartz directly and are not affected by the change in dielectric constant. Fan stubs, located one quarter wavelength from the intersection of the control supply and the transmission line, provide the appropriate RF short circuit condition to isolate the DC control supplies from the RF energy.

The second stage of the power divider is preferably arranged as a hybrid combiner network. The second stage can have four ports including two input ports 6, 6' and two output ports RF_OUT_A, RF_OUT_B. The second stage is preferably formed as a gold strip layer on the surface of the same quartz substrate having the first stage of the power divider. The two input ports 6, 6' are connected to respective transmission lines of the first stage. The two output ports, RF_OUT_A and RF_OUT_B, serve as outputs for the power divider. An arrangement as a hybrid power divider enables manipulation of both the phase and amplitude of the RF signals received at its input ports. Because very little RF signal flow occurs between the two input ports, predominate RF signal flow in the second stage is from the input ports to the output ports. The RF signal phase values at the two output ports of the power divider corresponding to the RF signal from one of the input ports of the hybrid combiner can differ by substantially ninety or one-hundred-eighty degrees, depending on the configuration of the combiner network. There can be two signals at each output port of the hybrid combiner when there is one signal applied to each of the input ports.

The first stage and the second stage are formed as an integrated thin film network. Because all components of the power divider can exist on a common monolithic substrate, such as quartz, manufacturing is easier and less costly.

The combination of dynamic power vectoring, dielectric material deposition and thin film network, provides dynamic RF power level distribution that is absent frequency dispersion and that can extend in frequency range well into the millimeter wave spectrum.

Frequency dispersion typically occurs in differential length transmission line networks. The variable dielectric properties of paraelectric materials, such as BST, provide a capability to alter the effective electric length of a given transmission line. In particular, a dynamic permittivity effect (i.e., change in dielectric constant) is produced by applying a control voltage across the material surface. Subsequently, different output lengths reside on variable dielectric material. Control of output lengths facilitates control of the respective S21/S31 phase lengths referenced from the single input to multiple output ports. Thus, in the first stage of the power divider control is accomplished by altering two complex RF power vectors.

In the second stage of the power divider, constructive or destructive combination of phase differentials through phase amalgamation achieve the desired power vector balance at the output ports of the power divider. The combination of phase differentials made by adding or subtracting the two complex power vectors resulting in appropriate addition or cancellation of power to the appropriate output port. Subsequently, power vector cancellation is achieved. Furthermore, frequency dispersion is negligible as balance is achieved because of operation based on vector arithmetic. In particular, while the degree of change in transmission line impedance is realized, the second order effect of frequency dispersion is insignificant with respect to the desired change in transmission line phase length.

Operation of the power divider will now be described. In normal operation, through differential voltage control of the variable dielectric material, a maximum imbalance of power distribution, between the second stage hybrid combiner output ports, occurs when the relative phase difference between the first stage variable length power splitter ports approach ninety degrees. At this point, complete power vector cancellation within the second stage combiner substantially provides one-hundred percent of the available incident power to one output port while simultaneously starving the other.

Rotating the relative phase difference in the first stage variable length power splitter ports back through zero towards ninety degrees reverses the imbalance. A zero degree relative phase difference in the first stage divider lengths provides an equal power division between output ports.

Figure 2:
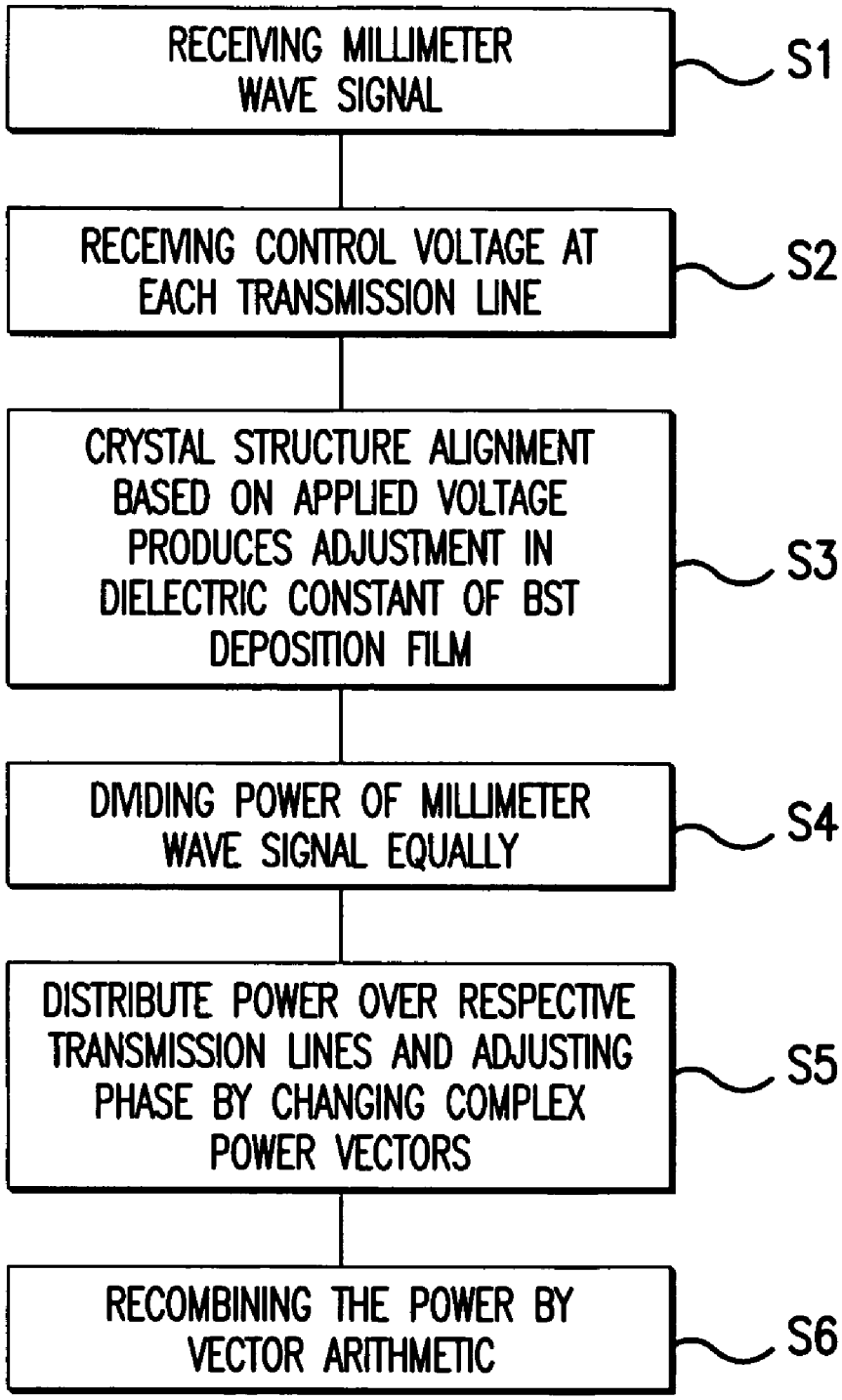
FIG. 2 is a flow diagram for the operation of the variable power divider.
Figure 3:
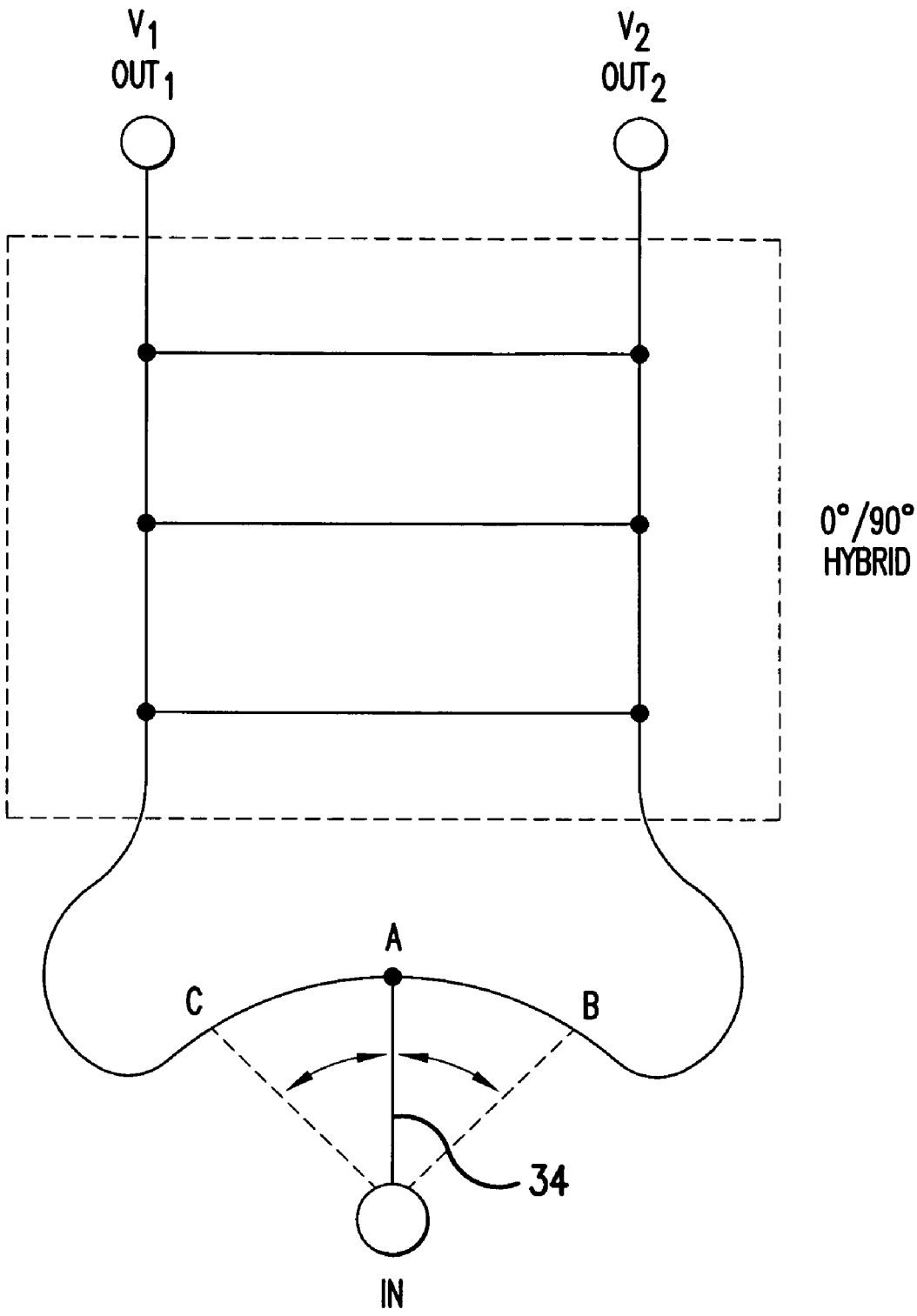
FIG.3 PRIOR ART
FIG. 3 illustrates a conceptual view of a prior art variable power divider.

FIG. 2 shows an example operation for a millimeter wave input signal. The power divider receives a millimeter band signal at RF_IN (step S1) and provides balanced power signals at output ports RF_OUT_A and RF_OUT_B. In order to provide the balanced power outputs, control voltages are applied at control ports CTRL_A and CTRL_B (step S2). The control voltage applied at port CTRL_A is fed to a gold layer formed over the dielectric deposition layer, causes alignment in the crystalline dielectric, and adjustment of an effective transmission line length (step S3). The effective transmission line length is adjusted based on the resulting dielectric constant of the variable dielectric material. The respective phase length is adjusted by a change in the complex power vector. A control voltage is applied at port CTRL_B to likewise adjust an effective transmission line length and respective phase length for a second transmission line (step S2). Provided an effective transmission line length for each transmission line, divided power of the millimeter band signal at respective phase lengths (step S4) is distributed over the respective transmission lines (step S5). A hybrid combiner receives the distributed power from the respective transmission lines and recombines the power by vector arithmetic of the complex power vectors to provide the phase-combined power as output at an appropriate port (step S6).

The present invention is capable of adjusting relative phase between two RF signals without any mechanical components, such as the adjustable control element of the prior art. The present invention exhibits efficient functionality that enables operation in very high frequency applications.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A monolithic thin film variable power divider for variable power level distribution of an RF signal, comprising:

a substrate having a main surface;

a first stage and a second stage, each formed as thin film networks on the main surface of said substrate, the first stage includes a plurality of transmission lines, at least one of the transmission lines having a variable dielectric deposition layer to adjust a phase difference of the RF signal between the plurality of transmission lines over a range from zero degrees to ninety degrees, the second stage includes a hybrid combiner, which obtains power vector cancellation for the phase difference.

2. The monolithic thin film power divider of claim 1, wherein said variable dielectric deposition layer is made of a variable crystalline dielectric material that is capable of electric polarization by application of voltage.

3. The monolithic thin film power divider of claim 2, wherein said variable crystalline dielectric material is a compound of Barium-Strontium-Titanate.

4. The monolithic thin film power divider of claim 1, wherein each of said plurality of transmission lines includes:

a metal strip line formed over the variable dielectric deposition layer; and a semiconductor cap connected to each end of the variable dielectric deposition layer, wherein said metal strip line extends over each said semiconductor cap, which provides a capacitor at each end of the respective transmission line.

5. A variable power divider, comprising:

a substrate;

a single input port receiving an RF signal;

a variable power splitter having a plurality of transmission lines, wherein at least one of said transmission lines is composed of a variable dielectric material;

at least one control line associated with the respective transmission line composed of variable dielectric material for supplying a respective input control voltage, wherein said input control voltage is varied in order to adjust a phase difference between the plurality of transmission lines is over a range from zero degrees to ninety degrees; and a hybrid power combiner having a plurality of input ports and a plurality of output ports, wherein said input ports are connected to respective ones of said transmission lines, wherein a complex power vector of the at least one transmission line is adjusted by changing an applied voltage to the variable dielectric material of the respective transmission line, wherein the variable power splitter and hybrid power combiner are formed on said substrate, and wherein the hybrid power combiner adds or subtracts complex power vectors of respective ones of said transmission lines in order to provide power to an output port or said plurality of output ports.

6. A variable power divider, comprising:

a quartz substrate having a metal. backing layer;

a first layer formed on the surface of the quartz substrate, the first layer including:

a first metal strip formed as a y-connection providing an input port for the variable power divider, said y-connection feeding:

a first semiconductor cap, a variable dielectric deposition strip made of a ferroelectric material, and a second semiconductor cap; and a second metal strip pattern formed as a power combiner network, wherein the second semiconductor caps are connected to input ports of the power combiner network; and a second layer formed on the first layer such tat a metal strip is formed on the first semiconductor cap, the second semiconductor cap, and the dielectric deposition strip, the metal strip includes a plurality of input lines, one for each branch of the first metal strip, wherein provided a voltage control signal supplied at a respective input line, a complex power vector for each respective dielectric deposition strip is adjusted and a RF signal provided at the input to the power divider is divided by vector arithmetic.

7. A method of varying and dividing RF power in an RF power divider having a single input port and multiple output ports, which are served by respective transmission lines, each said transmission line including a variable dielectric deposition layer, comprising:

receiving an RF signal;

applying a control voltage at a control port for each respective transmission line;

aligning crystalline structure of each said variable dielectric layer based on the respective applied control voltage;

dividing power of the RF signal equally;

adjusting the phase difference between the divided power over a range from zero degrees to ninety degrees based on varying said control voltage;

distributing the divided power to the transmission lines, wherein each said aligned crystalline structure provides a respective complex power vector; and recombining the power by vector arithmetic over the complex power vectors to optain power vector cancellation, thereby producing power level distributed substantially without frequency dispersion.

8. The method of varying and dividing RF power of claim 7, wherein the frequency of the RF signal. is within the millimeter band spectrum.

* * * * *